US008009838B2

(12) United States Patent
Lee et al.

(10) Patent No.: US 8,009,838 B2
(45) Date of Patent: Aug. 30, 2011

(54) ELECTROSTATIC LOUDSPEAKER ARRAY

(75) Inventors: Chih-Kung Lee, Taipei (TW); Wen-Ching Ko, Kaohsiung (TW); Ji-De Huang, Taipei (TW); Jia-Lun Chen, Tainan (TW); Ing-Yih Leu, Da-an District (TW); Wen-Hsin Hsiao, Longtan Township (TW); Chih-Chiang Cheng, Changhua (TW); Jen-Hsuan Ho, Taipei (TW); Wen-Jong Wu, Taipei (TW)

(73) Assignee: National Taiwan University (TW)

( * ) Notice: Subject to any disclaimer, the term of this patent is extended or adjusted under 35 U.S.C. 154(b) by 590 days.

(21) Appl. No.: 12/197,080

(22) Filed: Aug. 22, 2008

(65) Prior Publication Data

US 2009/0214049 A1 Aug. 27, 2009

(30) Foreign Application Priority Data

Feb. 22, 2008 (TW) ..... 97106183 A

(51) Int. Cl.
*G10K 11/16* (2006.01)
*H04R 1/40* (2006.01)

(52) U.S. Cl. ..... 381/77; 381/97

(58) Field of Classification Search ..... 381/71.1, 381/77, 97
See application file for complete search history.

(56) References Cited

U.S. PATENT DOCUMENTS 4,421,957 A 12/1983 Wallace, Jr.
4,823,908 A * 4/1989 Tanaka et al. ..... 181/175
5,848,166 A * 12/1998 Fisher et al. ..... 381/62
6,052,336 A 4/2000 Lowrey, III
6,128,395 A 10/2000 DeVries
6,215,883 B1 4/2001 Leonarz
6,229,899 B1 5/2001 Norris et al.
6,661,285 B1 12/2003 Pompei et al.
6,678,381 B1 * 1/2004 Manabe ..... 381/77
6,771,785 B2 8/2004 Pompei
6,775,388 B1 8/2004 Pompei
6,914,991 B1 7/2005 Pompei
7,215,782 B2 5/2007 Chen
7,391,872 B2 * 6/2008 Pompei ..... 381/111
7,564,981 B2 * 7/2009 Croft, III ..... 381/77
2009/0304198 A1 * 12/2009 Herre et al. ..... 381/66

* cited by examiner

*Primary Examiner* — Ramon Barrera

(74) *Attorney, Agent, or Firm* — Lowe Hauptman Ham & Berner, LLP

(57) ABSTRACT

A speaker system that includes an audio signal-receiving interface, a modulating circuit, a phase-control circuit, and a number of speaker units. The audio signal-receiving interface is configured to receive an audio signal, and the modulating circuit is coupled with the audio signal-receiving interface. The modulating circuit is configured to modulate a low frequency component of the audio signal and to generate a modulated signal. The phase-control circuit is coupled with the modulating circuit and the audio signal-receiving interface. The phase-control circuit is configured to receive the modulated signal and a high-frequency component of the audio signal and to control a phase of the modulated signal, a phase of the high-frequency component of the audio signal, or both. The speaker units are coupled with the phase-control circuit and configured to generate sound waves based on signals supplied by the phase-control circuit.

24 Claims, 5 Drawing Sheets

ELECTROSTATIC LOUDSPEAKER ARRAY

PRIORITY

This application is claims the benefit of priority of Taiwan Patent Application No. 097106183, filed Feb. 22, 2008 and entitled "An Electrostatic Loudspeaker Array System."

TECHNICAL FIELD

This invention relates to audio devices, and more particularly, to a speaker system.

BACKGROUND

A speaker system may include a collection of individual loudspeakers in an array, a line, or a co-planar arrangement. Individual loudspeakers in a speaker system may use one or more types of various speaker designs, such as moving-coil speakers, piezoelectric speakers, and electrostatic speakers. Many conventional speakers are relatively large and less likely to meet the increasing demands for lightweight, thin, or small electronic devices. To make speakers more portable, planar or flexible speakers have been developed. As another example, piezoelectric speakers may be made flexible by employing light, flexible membrane materials, such as polyvinylidene fluoride (PVDF) films.

One of the characteristics considered in evaluating a loudspeaker or a speaker system is directivity, which may be measured by sensing the sound pressures of sounds radiated from a speaker or speaker array to various directions. In a loudspeaker system, an increased directivity may be implemented in certain applications, so that the sound energy or wave is radiated in toward a certain direction or toward a narrower area. Increased directivity may prevent howling or other effects that may affect the characteristics of the sound heard by a listener.

A number of approaches were employed to provide better directivity of speakers. As an example, steering technology may be applied to control the phase or phases of audio signals. As another example, ultrasonic transducers may be employed in parametric audio systems for generating sonic or ultrasonic signals in nonlinear transmission media. Specifically, a parametric audio system, which is generally directional, may include components such as an amplitude modulator, driver amplifier, and an ultrasound transducer array. The amplitude modulator may modulate signals so that audio waves may be carried within the ultrasound wave, thereby using the ultrasound wave as a carrier to carry the audio waves to a pointed direction. One or more driver amplifiers may be used amplify the modulated signal, and an ultrasound transducer array having ultrasonic transducers may be used to generate ultrasound waves and send through the air along a selected path of projection.

Because of the non-linear propagation responses of the air to sound waves, the modulated signals or waves may demodulated as it passes through the air, thereby regenerating the carried sound wave along the selected path. The transducer in a parametric audio system may be driven by the driver amplifier, which may require a high voltage signal in hundreds of volts. The use of high voltage connections between the driver amplifiers and the transducers may increase the size and cost of the system in some examples.

Therefore, it may be desirable in some applications to provide a speaker array that may be directional or may be flexible in its directivity characteristics.

SUMMARY OF THE INVENTION

In one exemplary embodiment, the present disclosure is related to a speaker system that includes an audio signal-receiving interface, a modulating circuit, a phase-control circuit, and a number of speaker units. The audio signal-receiving interface is configured to receive an audio signal, and the modulating circuit is coupled with the audio signal-receiving interface. The modulating circuit is configured to modulate a low frequency component of the audio signal and to generate a modulated signal. The phase-control circuit is coupled with the modulating circuit and the audio signal-receiving interface. The phase-control circuit is configured to receive the modulated signal and a high-frequency component of the audio signal and to control a phase of the modulated signal, a phase of the high-frequency component of the audio signal, or both. The speaker units are coupled with the phase-control circuit and configured to generate sound waves based on signals supplied by the phase-control circuit.

In another exemplary embodiment, the present disclosure is related to a speaker system including an audio signal-receiving interface, a modulating circuit, a phase-control circuit, a number of speaker units; and one or more sound detection unit(s). The audio signal-receiving interface is configured to receive an audio signal and is coupled with the modulating circuit. The modulating circuit is configured to modulate a low frequency component of the audio signal and to generate a modulated signal. The phase-control circuit is coupled with the modulating circuit and the audio signal-receiving interface. The phase-control circuit is configured to receive the modulated signal and a high frequency component of the audio signal and to control a phase of the modulated signal, a phase of the high frequency component of the audio signal, or both. The speaker units are coupled with the phase-control circuit. The sound detection unit(s) may be coupled the audio signal-receiving interface, the modulating circuit, the phase-control circuit, or a combination of two or more of them. The sound detection unit(s) may be configured to provide signals for a feedback control.

DETAILED DESCRIPTION OF THE INVENTION

Figure 1:
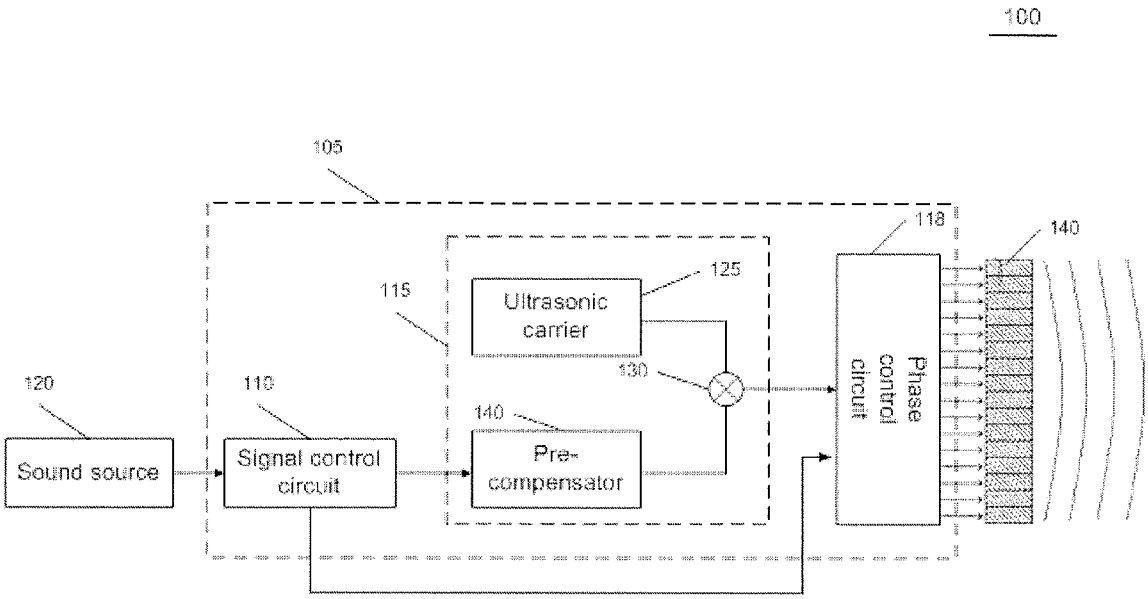
FIG. 1 illustrates an exemplary block diagram of a speaker system, consistent with certain disclosed embodiments.

FIG. 1 illustrates an exemplary block diagram of a speaker system, consistent with certain disclosed embodiments.

Referring to FIG. 1, a speaker system 100 may include a control system 105 and a number of speakers 108. The control system 105 may be coupled to the speakers 108 separately or jointly. In one embodiment, the control system 105 includes a signal control circuit 110, a modulating circuit 115, and a phase-control circuit 118. The signal control circuit 110 may be configured to receive an audio signal from an audio source 120, such as through an audio signal-receiving interface that is for receiving one or more audio signal inputs.

The signal control circuit 110 may provide the low frequency component of the audio signal to the modulating circuit 115 and the high frequency component of the audio signal to the phase-control circuit 118. For example, when the audio signal from the audio source 120 includes a low frequency component that has a frequency range of 20 KHz or less, the low frequency component may be directed to the modulating circuit 115. The threshold level for the low frequency component may vary depending on the applications, the design, audio effects, etc. When the audio signal includes a high frequency component that has a frequency range of 40 KHz or more, the high frequency component may be directed to the phase-control circuit 118. In one embodiment, the signal control circuit 115 may function as a filter, such as a high-pass filter, a low-pass filter, or a combination of both.

The modulating circuit 115 in FIG. 1 may include an ultrasonic carrier generation unit 125, an amplitude modulator 130, and a pre-compensator 140 in one embodiment. In response to a low frequency component, the signal control circuit 110 may provide the low frequency component to the pre-compensator 140. The pre-compensator 140 may operate to prevent linear distortion caused by the modulating the low frequency component with an ultrasonic carrier. The pre-compensated signal from the pre-compensator 140 may be modulated at the amplitude modulator 130 with an ultrasonic carrier generated from the carrier generation unit 125. After the modulation, the modulated signal may be provided to the phase-control circuit 118 for phase control and amplification. The amplified signals from the phase-control circuit 118 may be output to the speakers to generate sound waves, such as sound waves with a designed directivity. In some embodiments, linear distortion may be prevented by using a linear filter to compensate the signal after the modulation.

The signal control circuit 110 may be configured to provide the high frequency component directly to the phase-control circuit 118. The phase-control circuit may provide phase control of the high frequency component and, in one embodiment, amplifies the signal. The amplified signal may be output to the speaker units 108.

Figure 2:
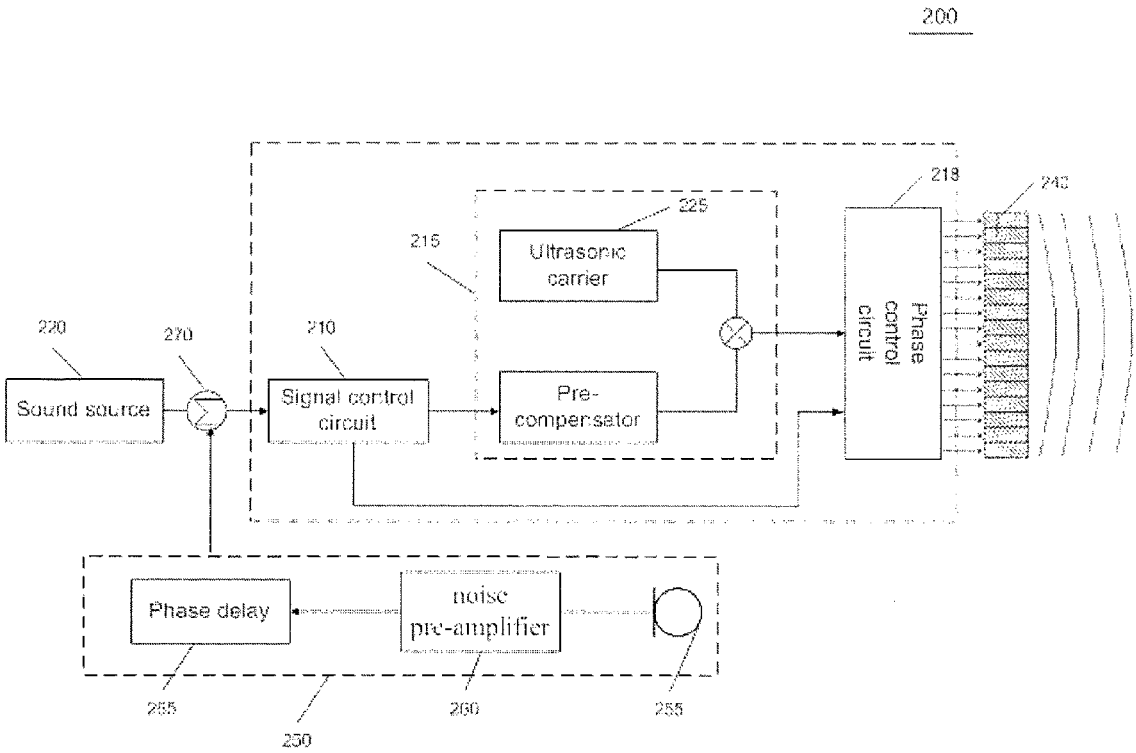
FIG. 2 illustrates an exemplary block diagram of another speaker system, consistent with certain disclosed embodiments.

In some applications, the speaker system may be used with environments with various levels of background or other noises. FIG. 2 illustrates an exemplary block diagram of another speaker system, consistent with certain disclosed embodiments. Referring to FIG. 2, a speaker system may include a noise cancellation circuit 250, which can cancel some or all of those noises. The noise cancellation system 250 may include one or more sound detection units, such as one or more microphones 255, a noise pre-amplifier circuit 260, and a phase-delay circuit 265.

The microphone 255 is used to collect sound information, such as noises from the surrounding environment, and provide signals for feedback control or noise control. The collected noise signals supplied from the microphone 255 may be provided to the pre-amplifier circuit 260, which may produce an amplified signal similar to the collected signal but with 180 degree difference in phase. This amplified signal is then supplied to a phase-delay circuit 265 to control the phase delay or minimize the phase difference. The output of the phase-delay circuit 265 is then provided to a mixer 270, which combine the noise cancellation signals with the audio signals from a sound source 220. The combined signals may be provided to a modulating circuit 215, a phase-control circuit 218, or both by a signal control circuit 210 based on the frequency spectrum of the signals. The speakers, in response to the amplified signals, may generate sound waves that may cancel some or part of the noises detected.

The speaker units in a speaker system may use one or more types of various speaker designs, such as electrostatic speakers, electret speakers, flexible electret speakers, flexible piezoelectric speakers, etc. In one example, an electrostatic speaker may be used.

Figure 3:
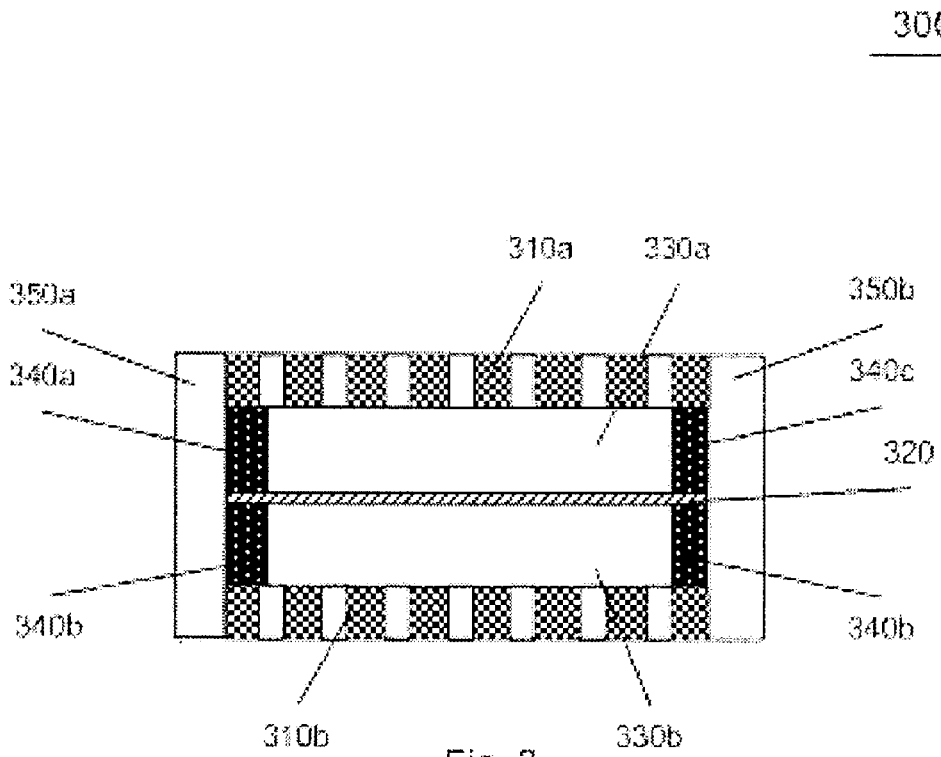
FIG. 3 illustrates a cross-sectional view of an exemplary structure for an electrostatic speaker, consistent with certain disclosed embodiments.

FIG. 3 illustrates a cross-sectional view of an exemplary structure for an electrostatic speaker, consistent with certain disclosed embodiments. Referring to FIG. 3, an electrostatic speaker 300 may operate on the principle of Coulomb's law, which means two members with equal and opposite charge may generate a push-pull force between them. In one embodiment, an electrostatic speaker may include two porous electrodes 310*a* and 310*b*, and a diaphragm 320 placed between the electrodes. Elements 340*a*, 340*b*, 340*c* and 340*d* may be made of insulating materials and may be used for separating the diaphragm 320 from the electrode plates 310*a* and 310*b* to form cavities 330*a* and 330*b*, which allows the diaphragm 320 to vibrate more freely or allow the sound waves to be transmitted outside the enclosure. The electrodes 310*a* and 310*b* and diaphragm 320 may be held in place by holding members 350*a* and 350*b*.

Figure 4:
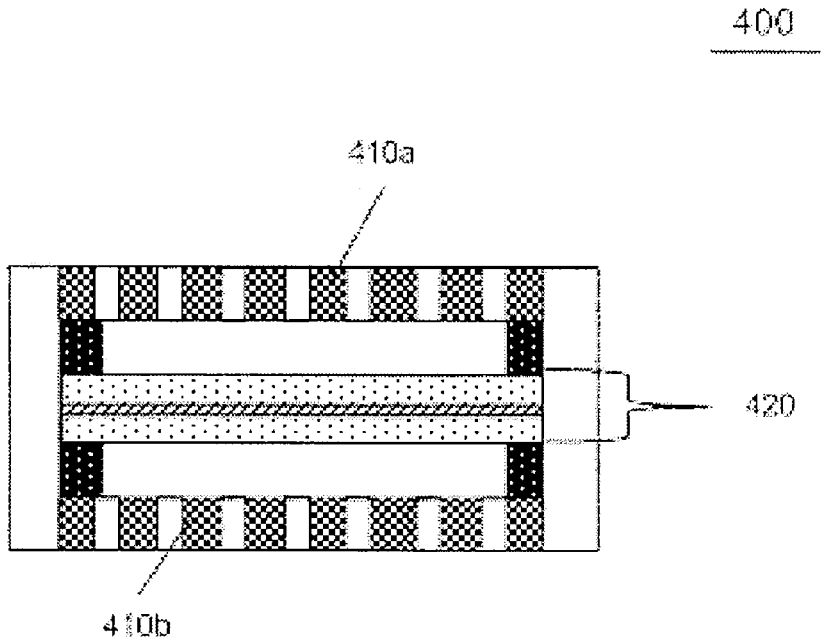
FIG. 4 illustrates a cross-sectional view of another exemplary structure for an electrostatic speaker, consistent with certain disclosed embodiments.

FIG. 4 illustrates a cross-sectional view of another exemplary structure for an electrostatic speaker, consistent with certain disclosed embodiments. Referring to FIG. 4, the electret speaker 400 may include an electret diaphragm 420 having a conductive layer sandwiched between two electret layers. The design provides an alternative configuration for an electrostatic speaker.

Figure 5:
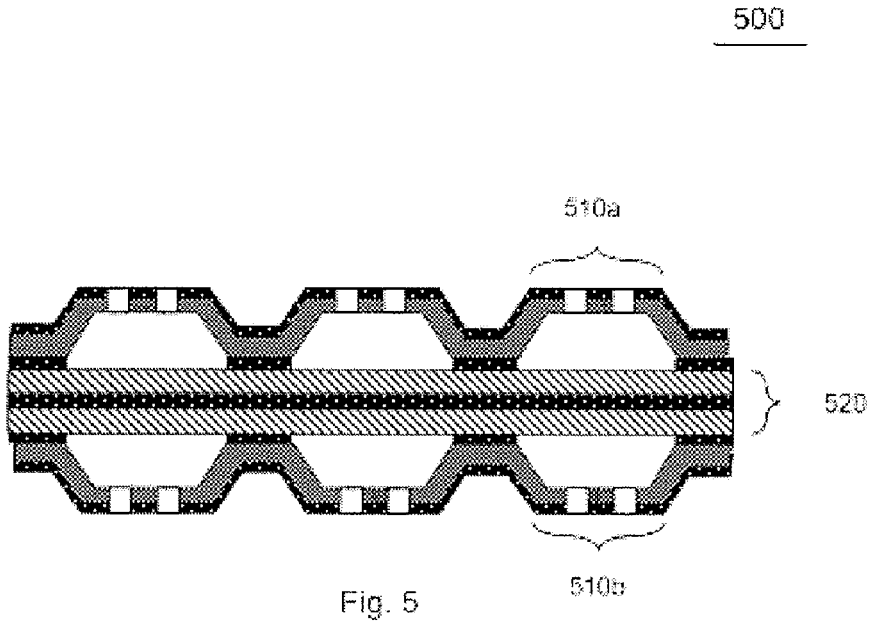
FIG. 5 illustrates a cross-sectional view of an exemplary structure for an electrostatic speaker system, consistent with certain disclosed embodiments.
Figure 6:
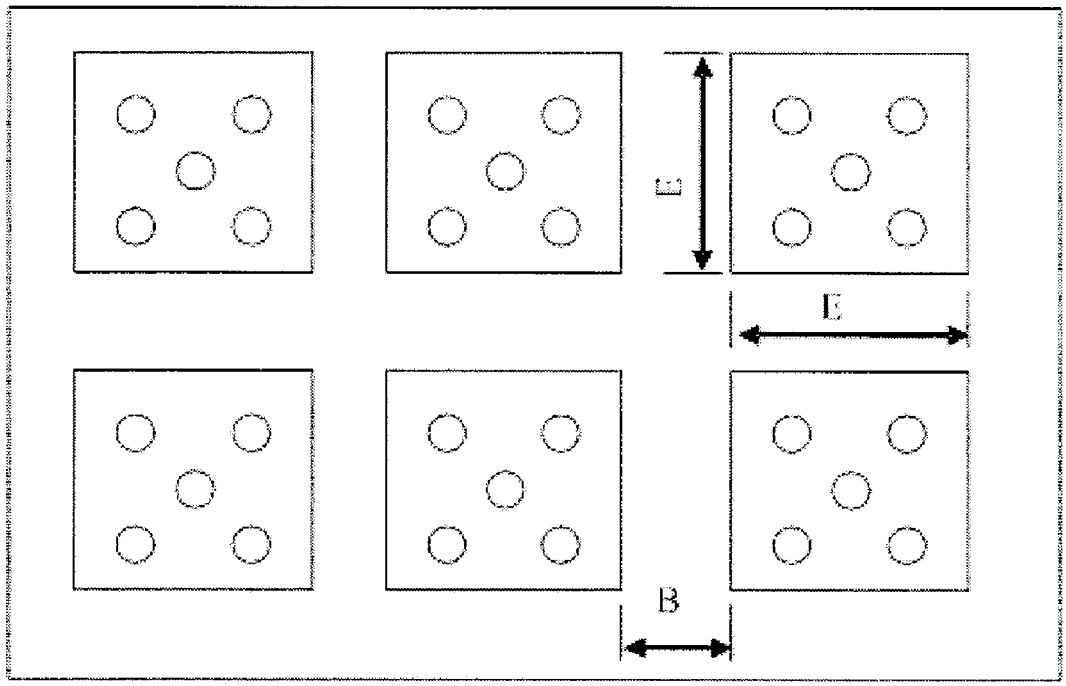
FIG. 6 illustrates a top view of an exemplary speaker system or array, such as the electrostatic speaker system illustrated in FIG. 5.
Figure 7:
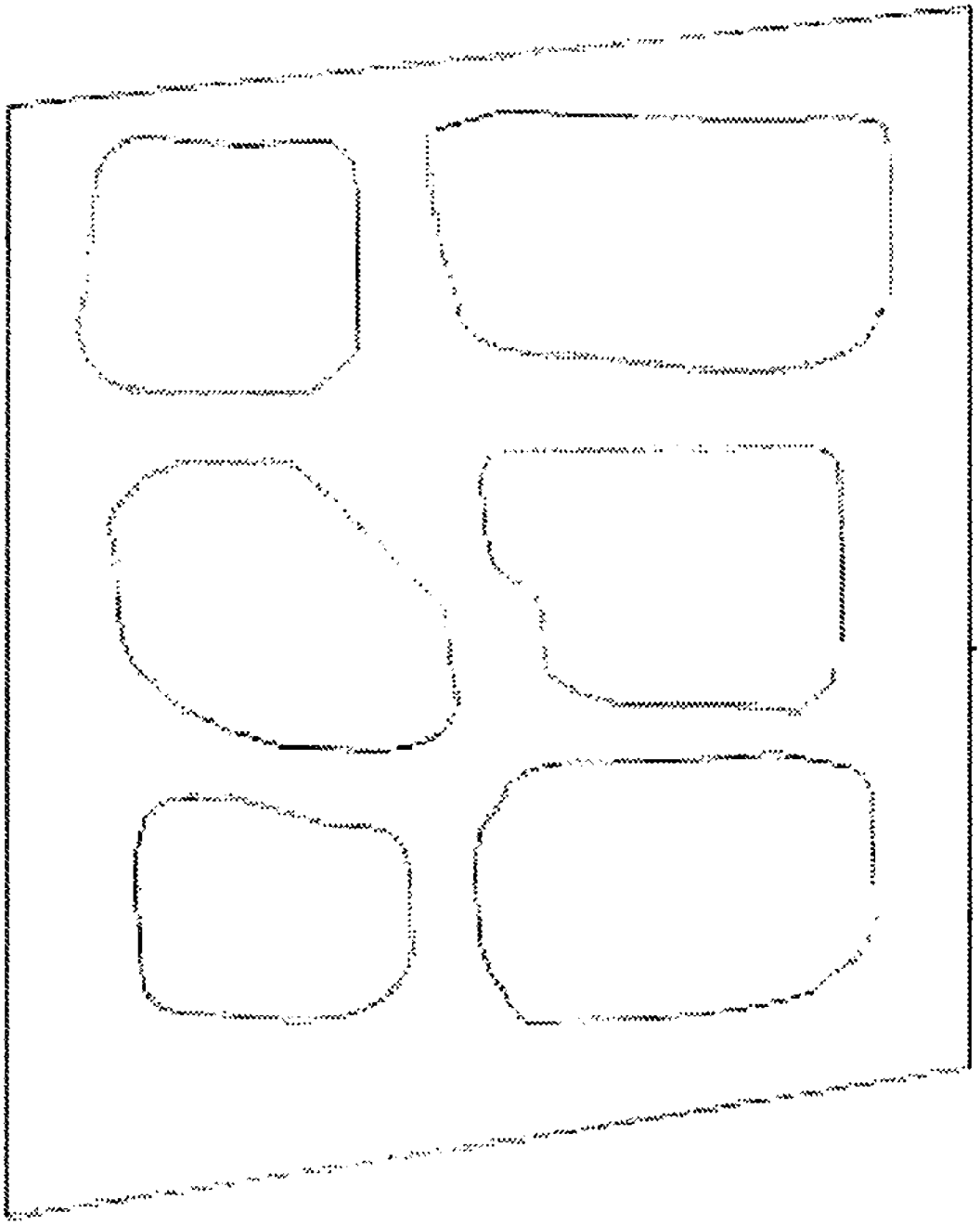
FIG. 7 illustrates a schematic diagram of exemplary electrode shapes of speakers or a speaker array, consistent with certain disclosed embodiments.

FIG. 5 illustrates a cross-sectional view of an exemplary structure for an electrostatic speaker system, consistent with certain disclosed embodiments. Referring to FIG. 5, a flexible electret speaker or speaker system may have multiple sub-sections with flexible holding members holding them together. In other word, each enclosure shown in FIG. 5 may be move or bend in relation to other enclosures. In one embodiment, the flexible electret speaker 500 may include an electret diaphragm 520 placed between flexible enclosures 510*a* and 510*b*. The speaker unit illustrated in FIG. 5 may be considered as a single speaker having three sub-sections. A number of these speaker units may be combined together and arranged in an array, such as the array illustrated in FIG. 6. Referring to FIG. 6, each rectangular or square may represent a speaker device, such as an electret speaker with an enclosure as shown in FIG. 6. The speaker devices may have flexible holding members between two adjacent units. In one embodiment, each unit may have a square shape with a length of "E" on each side and with a holding member in the width of "B." The shapes of the speaker units, their dimensions, and distances from each may vary for different designs or applications. The enclosures 510*a* and 510*b* may be provided in various shapes, such as square, circle, polygon or any other regular or irregular shapes as shown in FIG. 7. The cross-sectional shape of the enclosures may also vary.

In one embodiment, a speaker system with multiple speaker units or multiple sets of electrodes may be controlled separately. The interaction or interference among the multiple speaker units may be considered. As an example, the movement of an electret or diaphragm in one speaker may affect the movement of that of other units nearby. The effect of speaker interaction or interference may be considered.

Assuming there is N sets of electrodes in one embodiment, the amplitude effect of the i-th electrode on the j-th electrode may be $A_{ij}(\omega,A)$ and phase effect is $P_{ij}(\omega,A)$. A matrix of [A] representing the amplitude effects and a matrix of [P] representing the phase effects, each being N×N in size, may be obtained through measurement, simulation, or both. [A] and [P] may vary depending on the materials, sizes, and other factors of the electrodes or speaker units. The parameters or parameter matrixes may be used to control how the speakers are driven by the signals.

For example, the signals to a particular speaker unit may be adjusted by considering or by compensating the amplitude, phase, or both effects caused by other speakers. Moreover, different signals may be supplied to different speakers to improve the acoustic effects, the directivity of the speaker system, or both. As another example, the frequency distribution or effect, such as a low-frequency effect, of speakers may be adjusted or compensated. In one embodiment, one or more pre-compensation circuit may be coupled with a signal receiving interface or signal input terminals to compensate or adjust the signals before they are amplified and supplied to speaker units.

In one embodiment, the design or selection of speakers in a speaker system may include many different considerations such as enclosure shape, enclosure size, diaphragm size, diaphragm shape, diaphragm material and thickness, etc. For example, adjusting one of these factors may affect the phase and other characteristics of the sound waves generated. In one example, adjusting one or more factors, such as enclosure size, enclosure shape, diaphragm size, diaphragm shape, etc., may change the phase of the sound waves and, therefore, may control the direction(s) or directivity of the sound waves. In some examples, the combined characteristics of a speaker array and the individual characteristics of the speakers in the array may be tuned or varies to adjust the directivity of the array or other sound effects of the array.

In operation, the output signals of the phase-control circuit 118 of FIG. 1 may be supplied to the electrodes of one or more electrostatic speakers. For example, the output signals may be supplied to the electrodes 310*a* and 310*b* illustrated in FIG. 3, the electrodes 410*a* and 410*b* illustrated in FIG. 4, and the electrodes or enclosures 510*a* and 510*b* of FIG. 5.

It will be apparent to those skilled in the art that various modifications and variations can be made in the speaker system disclosed. It is intended that the embodiments be considered as exemplary only, with the scope of the disclosed embodiments being identified by the following claims and their equivalents.

What is claimed is:

1. A speaker system, comprising:

an audio signal receiving interface being configured to receive an audio signal;

a modulating circuit coupled with the audio signal-receiving interface, the modulating circuit being configured to modulate a low frequency component of the audio signal to generate a modulated signal;

a phase-control circuit coupled with the modulating circuit and the audio signal-receiving interface, the phase-control circuit being configured to receive the modulated signal and a high-frequency component of the audio signal and to control at least one of (1) a phase of the modulated signal and (2) a phase of the high-frequency component of the audio signal; and a plurality of speaker units coupled with the phase-control circuit and configured to generate sound waves based on signals supplied by the phase-control circuit.

2. The speaker system of claim 1, wherein the audio signal-receiving interface comprises a signal control circuit, the signal control circuit being configured to provide the low frequency component of the audio signal to the modulating circuit and to provide the high frequency component of the audio signal to the phase-control circuit.

3. The speaker system of claim 1, wherein the modulating circuit further comprises a pre-compensation circuit, the pre-compensation circuit being configured to compensate for a distortion in modulating a carrier with the low frequency component of the audio signal.

4. The speaker system of claim 3, wherein the carrier comprises an ultrasound signal.

5. The speaker system of claim 1, wherein the phase-control circuit comprises an amplifier, the amplifier being configured to amplify the modulated signal and the high frequency component of the audio signal.

6. The speaker system of claim 1, further comprising a noise-cancellation circuit coupled to the audio signal-receiving interface, the noise cancellation circuit being configured to remove noise from a surrounding environment.

7. The speaker system of claim 6, wherein the noise-cancellation circuit comprises at least one microphone configured to detect the noise.

8. The speaker system of claim 7, wherein the noise-cancellation circuit further comprises a noise pre-amplifier circuit coupled to the at least one microphone, the noise pre-amplifier circuit being configured to amplify collected noise signals and generate a noise-cancellation signal.

9. The speaker system of claim 8, wherein the noise-cancellation circuit further comprises a phase-delay circuit to control a phase delay in the noise-cancellation signal.

10. The speaker system of claim 9, wherein the audio signal-receiving interface receives the noise-cancellation signal and combines the noise-cancellation signal to the audio signal.

11. The speaker system of claim 1, wherein the speaker units comprise at least one of electrostatic speakers, electret speakers, flexible electret speakers, and flexible piezoelectric speakers.

12. The speaker system of claim 1, wherein the low frequency component of the audio signal has a frequency of no more than 20 KHz.

13. The speaker system of claim 1, wherein the high frequency component of the audio signal has a frequency of no less than 40 KHz.

14. A speaker system comprising:

an audio signal-receiving interface being configured to receive an audio signal;

a modulating circuit coupled with the audio signal-receiving interface, the modulating circuit being configured to modulate a low frequency component of the audio signal and to generate a modulated signal;

a phase-control circuit coupled with the modulating circuit and the audio signal-receiving interface, the phase-control circuit being configured to receive the modulated signal and a high frequency component of the audio signal and to control a phase of at least one of the modulated signal and the high frequency component of the audio signal;

a plurality of speaker units coupled with the phase-control circuit; and at least one sound detection unit coupled with at least one of the audio signal-receiving interface, the modulating circuit, and the phase-control circuit, the sound detection unit being configured to detect sound and provide signals for feedback control.

15. The speaker system of claim 14, wherein the audio signal-receiving interface comprises a signal-control circuit, the signal-control circuit being configured to provide the low frequency component of the audio signal to the modulating circuit and to provide the high frequency component of the audio signal to the phase-control circuit.

16. The speaker system of claim 14, wherein the modulating circuit further comprises a pre-compensation circuit, the pre-compensation circuit being configured to compensate for a distortion in modulating a carrier with the low frequency component of the audio signal.

17. The speaker system of claim 16, wherein the carrier comprises an ultrasound signal.

18. The speaker system of claim 14, wherein the phase-control circuit comprises an amplifier, the amplifier being configured to amplify the modulated signal and the high frequency component of the audio signal.

19. The speaker system of claim 14, wherein the sound-detection unit comprises at least one microphone to detect noise from a surrounding environment.

20. The speaker system of claim 14, further comprising a noise-cancellation circuit having a noise pre-amplifier circuit coupled to the sound detection device, the noise pre-amplifier unit being configured to amplify a collected noise signal and to generate a noise-cancellation signal.

21. The speaker system of claim 20, wherein the noise-cancellation circuit further comprises a phase-delay circuit to control a phase delay in the noise-cancellation signal.

22. The speaker system of claim 21, wherein the audio signal-receiving interface receives the noise-cancellation signal and combines the noise-cancellation signal with the audio signal.

23. The speaker system of claim 14, wherein the plurality of speaker units comprise at least one of electrostatic speakers, electret speakers, flexible electret speakers, flexible piezoelectric speakers.

24. The speaker system of claim 14, wherein the at least one sound detection unit is coupled with a noise cancellation circuit, the noise cancellation circuit being coupled with the audio signal-receiving interface and being configured to generate audio signals for cancelling a noise.

* * * * *